United States Patent [19]

King

[11] 4,128,284

[45] Dec. 5, 1978

[54] CONSTRUCTION OF ARTICLES OF FURNITURE

[75] Inventor: Peter G. King, Wirral, England

[73] Assignees: Mackenzie King Holdings Limited, Chester; Formica Limited, London, both of England

[21] Appl. No.: 783,313

[22] Filed: Mar. 31, 1977

[51] Int. Cl.[2] ..... A47B 88/00; A47B 47/00

[52] U.S. Cl. ..... 312/330 R; 312/257 R; 312/263

[58] Field of Search ..... 312/111, 140, 263, 257 R, 312/330; 248/188; 403/300

[56] References Cited

U.S. PATENT DOCUMENTS

| | | | |
|---|---|---|---|
| 3,556,626 | 1/1971 | Schock | 312/330 |
| 3,752,553 | 8/1973 | Bildahl et al. | 312/330 |
| 3,901,572 | 8/1975 | Litchfield | 312/330 |
| 4,042,288 | 8/1977 | Litchfield | 312/257 R |

*Primary Examiner*—Casmir A. Nunberg
*Attorney, Agent, or Firm*—Young & Thompson

[57] ABSTRACT

A set of parts for use in the construction of an article of furniture, particularly a drawer, comprising first and second panel members, each being of substantially constant external cross-section, and a connecting device for attachment to said panel members respectively in a manner to secure said panel members together at an angle to one another, one or each panel member being attached to the connecting device by an end portion of the panel member being received in a socket on the connecting device, the socket having an internal cross-section conforming with at least a major part of the cross-section of the panel member, and there being resiliently interengageable locking means, such as projections and recesses on the panel member and within the socket, to retain the end portion within the socket. The panel members may be attached to further panel members by further similar connecting devices.

8 Claims, 8 Drawing Figures

CONSTRUCTION OF ARTICLES OF FURNITURE

BACKGROUND OF THE INVENTION

This invention relates to the construction of articles of furniture and particularly, but not exclusively, to sets of parts for use in forming drawers.

In general known drawers have either been made of solid back and side panel members which are connected together by mitred or dove-tailed joints, or have been made of back and side panel members which are extruded hollow sections of plastics material connected together by connecting members having spigots which fit into the hollow ends of the panel members, which are provided near their ends with recesses to receive the spigots.

SUMMARY OF THE INVENTION

According to the invention there is provided a set of parts for use in the construction of an article of furniture comprising first and second panel members, each being of substantially constant external cross-section, and a first connecting device for attachment to said panel members respectively in a manner to secure said panel members together at an angle to one another, which connecting device defines at least one socket having an internal cross-section which substantially conforms with at least a major part of the cross-section of the first panel member so that an end portion of said first panel member may be received in said socket, there being provided retention means for retaining said end portion within said socket and comprising resiliently inter-engageable locking elements on said end portion and within said socket respectively.

There may be provided within said socket an end stop wall which is engageable by said end portion of said first panel to limit the extent to which said end portion may be inserted into the socket.

Said locking elements may comprise an inter-engageable projection and recess, a part of the connecting device being resilient so that said projection and recess are snap-fitted into engagement with one another as the end portion of the first panel member is entered in said socket. The recess may be provided within said socket and the projection provided on said end portion of the first panel member, or vice versa.

The projection preferably has a chamfer facing the direction of engagement between the first panel member and the socket in the connecting device.

Said socket may be defined by walls on the connecting device, at least one of said socket walls being formed with an open-ended slot to permit resilient deformation of said walls as said end portion is entered in said socket.

The connecting device may have a second socket set at an angle to said one socket and similar thereto.

The set of parts may include a third panel member and a second connecting device, similar to said first connecting device, for attachment to said third panel member and to said second panel member to secure said second and third panel members together at an angle to one another. A fourth panel member may also be provided together with third and fourth connecting devices for connecting said fourth panel member at an angle to said first and third panel members respectively.

Where the set of parts is for use in constructing a drawer, each of said first and third panel members may be provided, on that surface thereof which faces externally of the assembled drawer, with a slot for receiving a runner for the drawer, and each of said connecting devices is also provided with a slot for receiving said runner.

The invention includes within its scope a set of parts, of any of the kinds referred to above, when assembled together to form at least a part of an article of furniture, such as a drawer.

The invention is applicable to the construction of any article of furniture in which panels of substantially constant cross-section are to be connected together at an angle to one another, such as drawers, cabinets, boxes, and shelf assemblies. However, the invention is particularly applicable to drawers, and the following description will relate to the construction of drawers although it is to be understood that the invention is not limited to such articles.

DETAILED DESCRIPTION OF THE PREFERRED EMBODIMENTS

Figure 1:
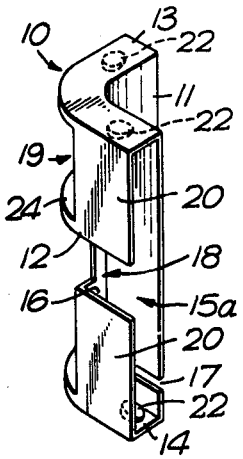
FIG. 1 is a perspective view of a connecting device for connecting a side panel member of a drawer to a back panel member.
Figure 2:
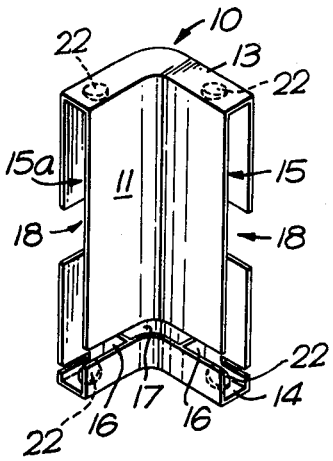
FIG. 2 is another perspective view of the connecting device of FIG. 1.

Referring to FIGS. 1 and 2, the connecting device 10 comprises side walls 11 and 12, a top wall 13, and a bottom wall 14 which define a generally hollow structure, the ends of the walls 11 to 14 defining two sockets 15 and **15*a* set at right angles to one another. Each socket also has an end stop wall 16. The connecting device 10 is rounded through 90° between the two sockets 15 and 15*a***.

As will be described later, the connecting device 10 is used for connecting together at right angles to one another, two panel members of a drawer, each panel member being of substantially constant external cross-section. Each of the sockets 15, **15*a*** has an internal cross-section which substantially conforms with the major part of the cross-section of one of the panel members so that an end portion of said one panel member may be received within the socket, in a manner to be described.

The side wall 11 of the device 10, which in use will face inwardly of the drawer, is provided near its lower edge with a slot 17 for receiving a drawer bottom panel 42 (FIG. 5), and the side wall 12, which in use will face outwardly of the drawer, is divided by a central lateral slot 18. The portions of the wall 12 above and below the slot 18 are interrupted at 19 so that the wall 12 comprises four portions 20 each of which defines part of one of the sockets 15, **15*a*. The top wall 13** and bottom wall 14 are formed, internally of the sockets 15 and 15*a* respectively, with projections 22 which snap into corresponding circular recesses in the drawer panel members, in a manner to be described, to retain the ends of the panel members in the sockets. Alternatively, the projections 22 may be formed, internally of the sockets 15, 15*a*, on the side walls 11 or 12 thereof. Each projection 22 is formed with a chamfer facing in the direction of engagement between the panel member and socket, so as to facilitate engagement of the projection into the corresponding recess in the panel member.

The slot 18 is provided for receiving a runner on which the assembled drawer is to slide and a strengthening rib 24 extends between the portions 20 above the slot 18.

In some forms of drawer construction the slots 18 and 17 may not be required, and in this case the walls defining the sockets 15 and 15*a* will be continuous and will surround the entire cross-section of each of the panel members.

Figure 3:
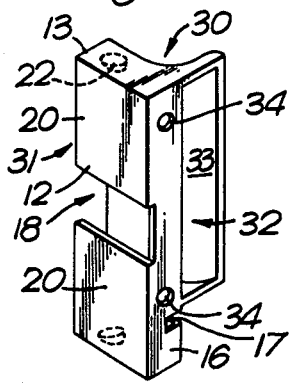
FIGS. 3 and 4 are perspective views of connecting devices for connecting side panel members of a drawer to a front panel member.
Figure 4:
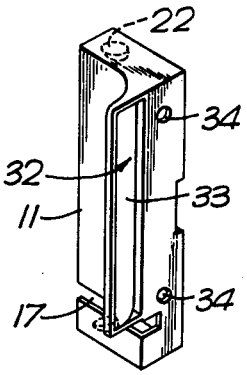

The connecting devices 30 shown in FIGS. 3 and 4 are for connecting the side panel members of a drawer to a drawer front panel member and have a portion generally indicated by 31 of the same general form as in the connecting device 10, having side wall sections 20, slots 17 and 18, a socket defined by side walls 11 and 12, top wall 13, bottom wall 14, and end wall 16, and projections 22 within the socket. The devices 30 also each have a portion generally indicated by 32 extending at right angles to the portion 31, but in this case the portion 32 simply comprises a single wall portion 33 providing a surface which is to abut the front panel member. The end wall 16 has holes 34 for receiving screws. As can be seen from FIGS. 3 and 4 the portion 32 extends from portion 31 only above the slot 17 and the outward facing corner is a right angle and the inward facing corner is rounded.

Figure 5:
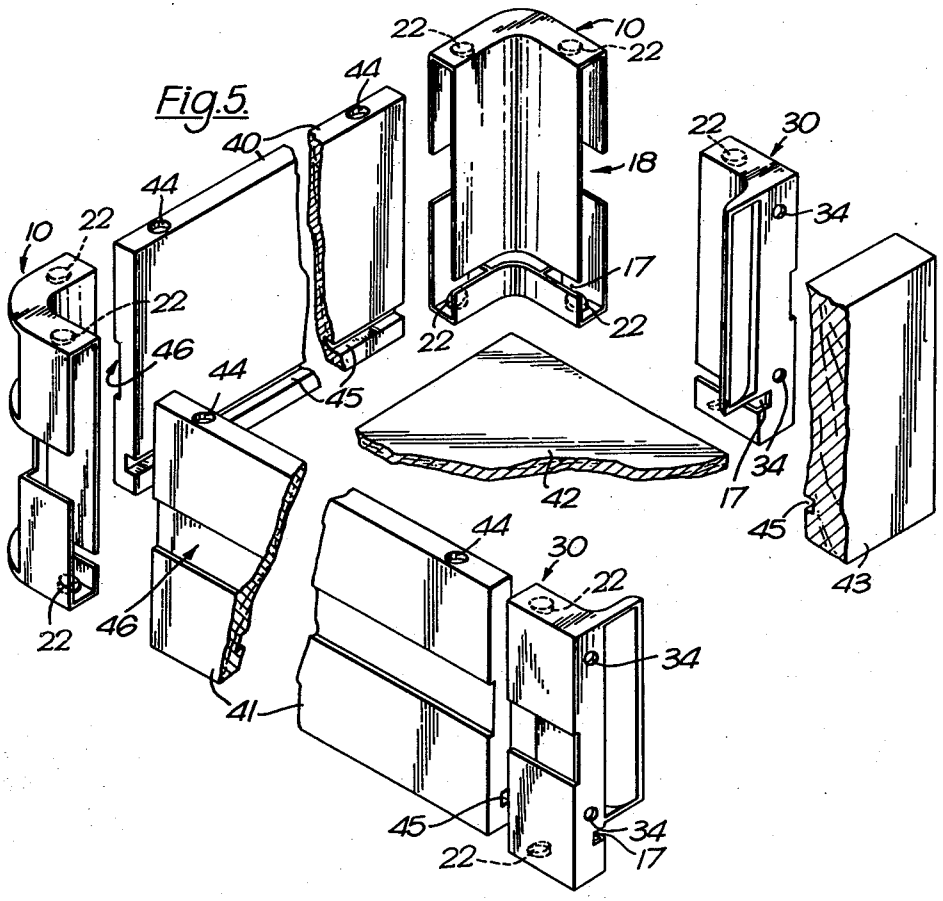
FIG. 5 is a perspective view of parts for use in forming a drawer and comprising the devices shown in FIG. 1 to 4 together with drawer side, back, front, and floor members before assembly.

The set of parts shown in FIG. 5 comprises a drawer back panel member 40, two side panel members 41 (only a part of one of which is shown), the drawer bottom panel 42, the front panel member 43, two connecting devices 10, and two connecting devices 30. Only parts of the panel members 21 and 43, and bottom panel 42, are shown.

In the upper and lower edges of each of the drawer side and back panel members there are provided circular recesses 44 to receive the projections 22 respectively within the sockets on the connecting devices 10 and 30. The drawer side, front and back panel members are further each provided, on their inwardly facing surfaces, with a groove 45, aligned with the slots 17, for receiving the edges of the drawer bottom panel 42. The outwardly facing surfaces of the drawer side panel members are each provided with grooves 46, aligned with the slots 18, for receiving the runners on which the assembled drawer is to slide.

The parts illustrated in FIG. 5 are assembled by first screwing the front connecting devices 30 to the drawer front panel member 43 through the holes 34, followed by insertion of the end portions of the drawer side and back panel members 41 and 40 in the sockets 15, 15*a* of the back connecting devices 10 where they are retained by the resilient engagement of the projections 22 within the recesses 44. The drawer bottom panel is then inserted in the slots 17 and grooves 45 of the assembled drawer panel members. The assembly is then fastened to the drawer front panel member 43 by insertion of the front end portions of the drawer side panel members 41 in the sockets of the front connecting devices 30, where they are retained by the resilient engagement of the projections 22 within the recesses 44.

In the alternative and preferred embodiment shown in FIG. 6, the drawer components are generally similar to those described with reference to FIGS. 1 to 5, but in this case rectangular holes 51 are provided in the top and bottom walls, or in the side walls, of the connecting devices, and rectangular projections 52 are provided in the top and bottom edge faces of the drawer panel members, or (not shown) in the side faces thereof, for fastening the connecting devices to the drawer panel members. In addition slots 53 are provided in the side walls of the connecting devices to allow the top and bottom walls thereof to deflect more freely.

Each projection 52 comprises a separately formed plug having a chamfered rectangular head and inserted in a hole in the upper or lower edge of the panel member so that the head of the plug projects from the surface of the panel member edge with the chamfer on the head facing the end of the panel member. The connecting devices are then fastened to the drawer panel members by pushing the end portions of the drawer panel members into the sockets of the connecting devices so that the projecting chamfered heads of the plugs first deflect the top and bottom walls (or the side walls if the holes are so positioned) of the connecting devices and then snap-fit into the holes 51 of the connecting devices. The plugs 52 and holes 51 are preferably so disposed that they snap into engagement at the point where the end face of the panel member abuts the stop wall 16 of the socket.

Instead of the heads of the plugs 52 being chamfered to facilitate entry of the ends of the panel members into the sockets, the heads may be flat and the mouth of each socket may be chamfered at the point where the head of a plug 52 will pass into the socket.

Alternatively, each plug may have a flat head and be inserted in the panel member at an angle, so that the flat head is inclined towards the end of the panel member thereby facilitating entry of the end of the panel member into the socket.

In the above examples the slots 18 in the connecting devices are of substantially the same width as the grooves 46 in the side panel members 41. As a result of this, it will be apparent that each connecting device can only be used with a side panel member having a groove the position of which coincides exactly with the slot in the connecting device. In practice, there is no single standard position for the groove in a drawer side panel member since drawers for different purposes may require to have the grooves in different locations. This means, therefore, that for each drawer side panel member having its slot or groove in a different position it is necessary to manufacture a different connecting device having its slot 18 in a corresponding position. This may be inconvenient and expensive.

Figure 7:
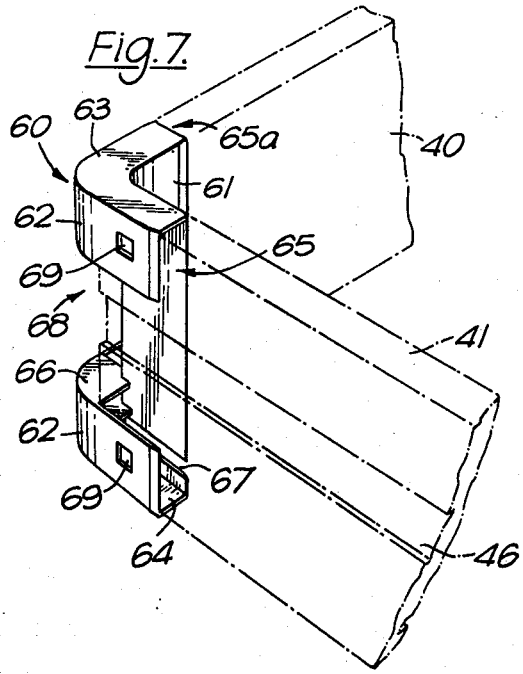
FIG. 7 is a perspective view of an alternative form of connecting device for connecting a side panel member of a drawer to a back panel member.
Figure 8:
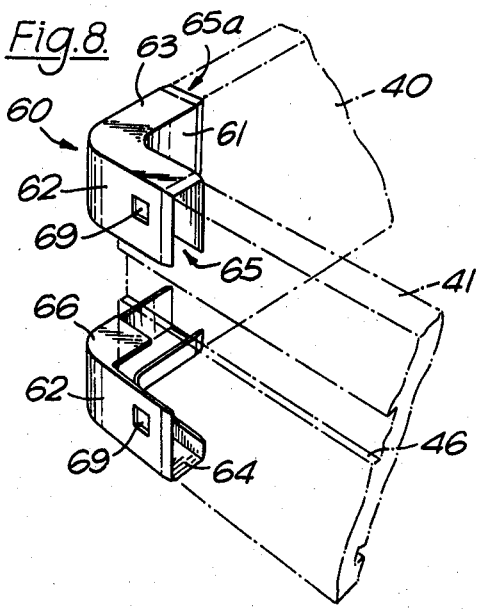
FIG. 8 is a perspective view of a further form of connecting device.

FIGS. 7 and 8 show modified forms of the connecting device which may be used with a variety of drawer side panel members having their grooves in different positions.

The connecting device 60 shown in FIG. 7 comprises side walls 61 and 62, a top wall 63, and a bottom wall 64, which define a generally hollow structure, the ends of the walls 61, 62, 63, 64 defining sockets 65 and 65*a*, set at right angles to each other, which receive respectively the end portions of the drawer side panel member 41 and the drawer back panel member 40, both indicated in chain lines. The side wall 61 which, in use, will face inwardly of the drawer, is provided with a slot 67 extending all the way round the wall near the bottom of the device for receiving the drawer bottom panel 42. The side wall 62 which, in use, will face outwardly of the drawer, is divided by a central lateral slot 68 for receiving the runners on which the assembled drawer will slide. At the top and bottom edge of the slot 68 there are provided generally square strengthening ribs 66 connecting the side walls 61 and 62.

Figure 6:
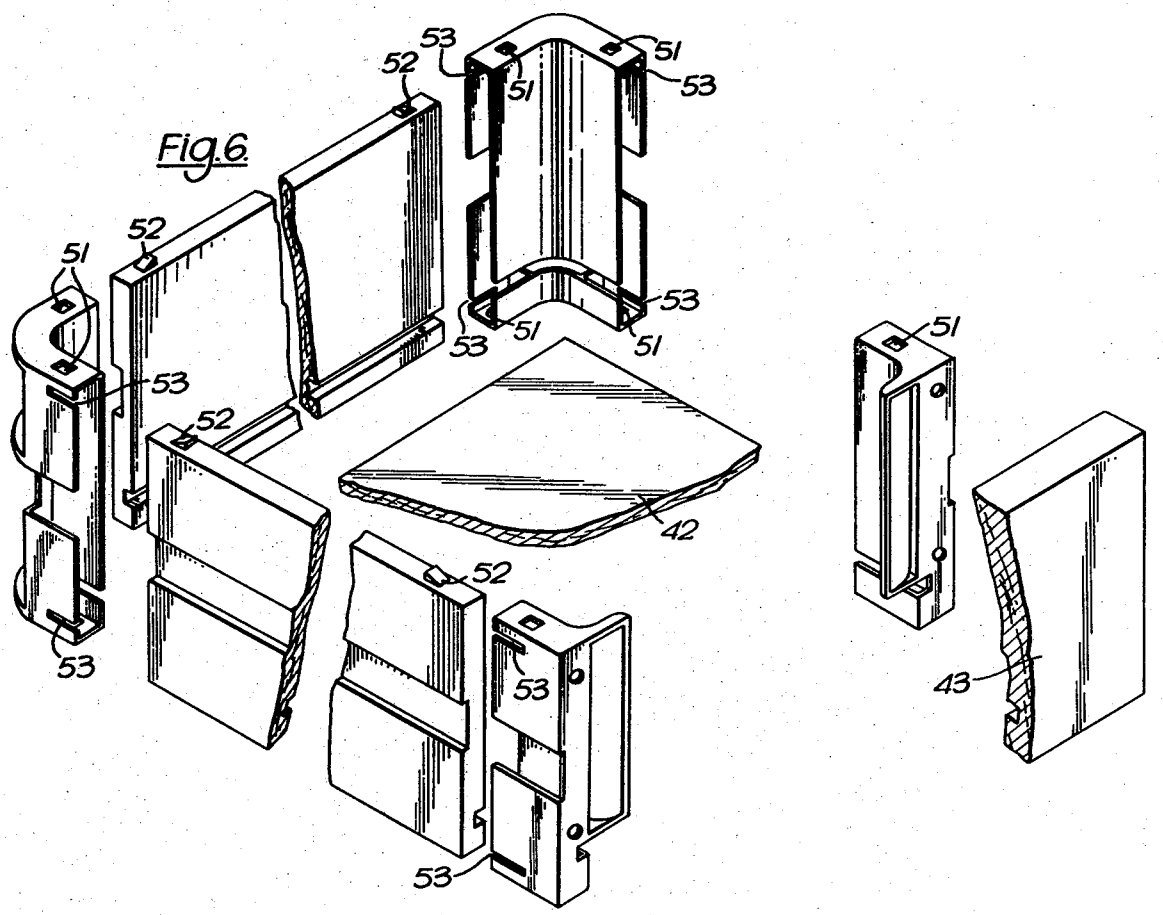
FIG. 6 is a perspective view of a modified form of the parts of FIG. 5.

The outwardly facing side wall 62 is formed with square holes 69 on opposite sides of the slot 68 for receiving projections (not shown) provided on the panel members or for receiving pins to assist in securing the connecting device to the drawer wall members in the case where other projections and recesses (also not shown) are provided in similar fashion to the projections and recesses of FIG. 5 or FIG. 6. The holes 69 could also be round or of any other suitable shape.

As in the arrangements of FIGS. 5 and 6, the drawer side panel member 41 is formed with an outwardly facing groove 46 into which a runner, on which the drawer is to slide, will project. As will be seen from FIG. 7, the slot 68 in the connecting device is, in this case, considerably wider than the groove 46 so that the groove will be unobstructed by the connecting device despite variations in the location of the groove 46 in different side panel members. Thus the same connecting device is suitable for use with a variety of side panel members. Although the device can be of any required overall height, this will in practice generally be in a range of 85 mm to 180 mm. Within this range the upper and lower portions may each have a constant height of 33 mm regardless of the overall height of the device.

In the alternative construction shown in FIG. 8, the connecting device is formed in two separate parts. The device may be regarded as being similar to the one-piece device of FIG. 7, but with a central portion of the inner wall 61 removed opposite the slot 68 in the outer wall 62. The spacing apart of the two parts of the device, when fitted to a drawer side panel member, is greater than the width of the groove 46 so that, again, the groove will be unobstructed by the connecting device despite variations in the location of the groove 46 in different side panel members. In the arrangement of FIG. 8, the interengaging projections and recesses for retaining the ends of the panel members in the sockets of the connecting device are provided on the side faces of the panel members and sockets.

Instead of the two parts of the connecting device being completely separate, as shown in FIG. 8, they may be connected by a bridging element, not shown, which maintains the parts in a fixed spaced relationship. It will be appreciated that the bridging element must not obscure any part of the groove 46 in the side panel member of the drawer when the device is in use. The bridging element may be permanently connected to the two parts of the device or may be arranged to be detachable therefrom.

In the above described embodiments, the connecting devices may be mouldings of thermoplastics material and the drawer panel members may be solid chipboard covered with a thin coating of P.V.C. The embodiments thus give the advantages that the drawer panel members are cheap to manufacture and a robust assembly is provided which has no weak points at which the drawer panel members and connecting devices can break before, during or after assembly. In alternative constructions, the drawer panel members may be of wood or entirely of plastics material, for example they may comprise hollow extrusions of plastics material. The connecting devices may be of material other than plastics, for example they may be formed from metal. However, whatever materials are used, the arrangement must be such as to permit resilient inter-engagement of the projections and recesses which retain the parts together.

Additional fastening between the connecting devices and drawer panel members may be provided by screws, nails, staples or the like, or by an adhesive.

The projections on the panel members or within the sockets on the connecting devices may be of any suitable shape and may be provided by various means. Where the panel members or connecting devices are formed from plastics material, the projections may be integrally moulded therewith, or may be formed subsequently by deforming the plastics material. Alternatively the projections may be separate elements secured to the panel members or sockets by any suitable means such as by welding or by an adhesive, depending on the materials used. When the projections are provided on the panel members they may also be attached to the panel members by screws or pins, or they may be wedged in holes in the panel members, as described earlier. For example, each projection may comprise a head having an integral spike which is driven into the surface of the panel member.

In an alternative construction to those described earlier, the front panel member may be similar to the back panel member and connected to the side panel members by connecting devices similar to the devices 10, instead of by the connecting devices 30.

In addition the corners of the connecting devices may be angular rather than rounded and the ends of the drawer panel members to be received by the sockets in the connecting devices may be haunched by the thickness of the socket-defining walls of the devices, so that the connecting devices do not project beyond the surfaces of the drawer panel members. Since the depth of such haunching is very slight, the drawer panel members may still be regarded as being of substantially constant cross-section.

I claim:

1. A set of parts for use in the construction of an article of furniture comprising: a first panel member of substantially constant external cross-section; a second panel member of substantially constant external cross-section; a first connecting device for attachment to said panel members respectively in a manner to secure said panel members together at an angle to one another; a first socket on the connecting device having an internal cross-section which substantially conforms with at least a major part of the cross-section of the first panel member whereby an end portion of said first panel member may be received in said first socket; retention means for retaining said end portion within said first socket and comprising resiliently inter-engageable locking elements on said end portion and within said first socket respectively; a second socket on the connecting device set at an angle to said first socket, the internal cross-section of the second socket substantially conforming with at least a major part of the cross-section of said second panel member so that an end portion of said second panel member may be received in said second socket, and resiliently inter-engageable locking elements on said end portion and within said second socket respectively, said elements being arranged in similar manner to the locking elements on said first socket and said end portion of the first panel member.

2. A set of parts according to claim 1 and further comprising a third panel member and a second connecting device, similar to said first connecting device, for attachment to said third panel member and to said second panel member to secure said second and third panel members together at an angle to one another.

3. A set of parts according to claim 2 and further comprising a fourth panel member and third and fourth connecting devices for connecting said fourth panel member at an angle to said first and third panel members respectively.

4. A set of parts according to claim 3 wherein said third connecting device comprises a socket having an internal cross-section which substantially conforms with at least a major part of the cross-section of the first panel member so that an end portion of said first panel member may be received in said socket, there being provided retention means for retaining said end portion within said socket and comprising resiliently interengageable locking elements on said end portion and within said socket respectively and a surface disposed at an angle to the axis of said socket and for attachment of said fourth panel member, and wherein the fourth connecting device is similar to the third connecting device, having a socket of internal cross-section which substantially conforms with at least a major part of the internal cross-section of said third panel member so that an end portion of said third panel member may be received and retained in said socket and a surface disposed at an angle to the axis of said socket and for attachment to said fourth panel member.

5. A set of parts according to claim 2, and for use in constructing a drawer, wherein each of said first and third panel members is provided, on that surface thereof which faces externally of the assembled drawer, with a slot for receiving a runner for the drawer, and each of said connecting devices is also provided with a slot for receiving said runner.

6. A set of parts according to claim 5 wherein the slot in each connecting device is wider than the slot in each of said first and third panel members.

7. A set of parts according to claim 1, and for use in constructing a drawer, wherein each of said first and second connecting devices comprises two separate elements which co-operate to define two sockets set at right angles to one another, each element forming a portion of each socket.

8. A set of parts according to claim 7 wherein each of said first and third panel members is provided, on that surface which faces externally of the assembled drawer, with a slot for receiving a runner for the drawer, and wherein said two separate elements of each of said first and second connecting devices are so dimensioned that, when co-operating to define said sockets, they are spaced apart by a distance greater than the slot in each panel member.

* * * * *